US007714792B2

(12) United States Patent
Leveque et al.

(10) Patent No.: US 7,714,792 B2
(45) Date of Patent: May 11, 2010

(54) ARRAY ANTENNA WITH SHAPED REFLECTOR(S), HIGHLY RECONFIGURABLE IN ORBIT

(75) Inventors: Michel Leveque, Lagardelle sur Leze (FR); Eric Vourch, Toulouse (FR); Jacques Maurel, Cugnaux (FR)

(73) Assignee: Thales (FR)

( * ) Notice: Subject to any disclaimer, the term of this patent is extended or adjusted under 35 U.S.C. 154(b) by 163 days.

(21) Appl. No.: 11/995,525

(22) PCT Filed: Jul. 11, 2006

(86) PCT No.: PCT/FR2006/050708

§ 371 (c)(1),
(2), (4) Date: Jul. 9, 2008

(87) PCT Pub. No.: WO2007/007011

PCT Pub. Date: Jan. 18, 2007

(65) Prior Publication Data

US 2008/0303736 A1 Dec. 11, 2008

(30) Foreign Application Priority Data

Jul. 13, 2005 (FR) ..... 05 52175

(51) Int. Cl.
*H01Q 13/00* (2006.01)

(52) U.S. Cl. ..... 343/779; 343/778; 343/840

(58) Field of Classification Search ..... 343/777, 343/778, 779, 781 R, 781 P, 840, 912
See application file for complete search history.

(56) References Cited

U.S. PATENT DOCUMENTS 4,236,161 A * 11/1980 Ohm ..... 343/781 CA
4,338,608 A * 7/1982 Strauch et al. ..... 343/779

(Continued)

FOREIGN PATENT DOCUMENTS

EP 0795928 A2 9/1997

(Continued)

*Primary Examiner*—Tho G Phan
(74) *Attorney, Agent, or Firm*—Lowe Hauptman Ham & Berner, LLP

(57) ABSTRACT

An array antenna with reflector(s) (AR) comprises i) an array (RS) of at least two feeds (S1-S5), including a central feed (S1), arranged and positioned so as to transmit and/or receive beams (F1-F5) in chosen directions, ii) beam-forming means responsible for controlling the amplitude and phase of each of the feeds by means of amplitude/phase laws applied to their ports and providing an appropriate amplification level, in order for each feed (S1-S5) to transmit a chosen radiation pattern (forming a beam and comprising a main lobe) intended to cover a chosen zone (Z1-Z5), and iii) at least one reflector (RC) provided with a surface (SU) specifically for reflecting the beams delivered by the feeds and/or intended for the latter, and shaped tree-dimensionally so as to reflect the beam delivered by each feed (S1-S5) by spreading its energy such that it covers the chosen associated zone, that the main lobe of the radiation pattern associated with the central feed (S1) defines a primary coverage (CP) fully including each active coverage zone (ZC1,ZC2) of the antenna (AR), of chosen shape and dimensions, and that the main lobe of the radiation pattern associated with each non-central feed (S2-S5) at least partially overlaps the primary cover (CP).

20 Claims, 1 Drawing Sheet

U.S. PATENT DOCUMENTS

| | | | | |
|---|---|---|---|---|
| 4,792,813 | A * | 12/1988 | Rosen | 343/781 P |
| 4,965,587 | A * | 10/1990 | Lenormand et al. | 342/372 |
| 6,219,003 | B1 * | 4/2001 | Chandler | 343/779 |
| 6,882,323 | B2 * | 4/2005 | Peebles et al. | 343/781 R |
| 7,161,549 | B1 * | 1/2007 | Cuchanski et al. | 343/781 CA |
| 2004/0222932 | A1 | 11/2004 | Peebles et al. | |
| 2005/0140563 | A1 | 6/2005 | Eom et al. | |

FOREIGN PATENT DOCUMENTS

| | | | |
|---|---|---|---|
| EP | 0845834 | A2 | 6/1998 |
| EP | 0915529 | A1 | 5/1999 |
| EP | 1085598 | A2 | 3/2001 |

* cited by examiner

ARRAY ANTENNA WITH SHAPED REFLECTOR(S), HIGHLY RECONFIGURABLE IN ORBIT

CROSS-REFERENCE TO RELATED APPLICATIONS

The present Application is based on International Application No. PCT/FR2006/050708, filed on Jul. 11, 2006, which in turn corresponds to French Application No. 0552175 filed on Jul. 13, 2005, and priority is hereby claimed under 35 USC §119 based on these applications. Each of these applications are hereby incorporated by reference in their entirety into the present application.

FIELD OF THE INVENTION

The invention relates to array antennas with reflector(s), on board satellites and intended to transmit and/or receive beams of electromagnetic waves.

BACKGROUND OF THE INVENTION

The term "array antenna with reflector(s)" should be understood here to mean an antenna consisting of a set of feeds (or radiating elements), defining an array, and one or more reflectors.

The abovementioned array antennas with reflector(s) are of particular interest because they make it possible to form and position one or more beams radiating towards one or more given coverages. This beam formation is done by controlling the amplitude and/or phase at the feeds.

The capacity to modify the position and the shape of the coverages in orbit (double reconfigurability) is of particular interest, particularly to take account of the changes in the traffic, to take over from a failed satellite, or on changes of position in the orbital arc with retention of the link budget over a given zone. In order to allow for a double reconfigurability, the three solutions described below are most commonly used.

A first solution consists in using an active array antenna with direct radiation (or DRA), in other words an antenna with no reflector. This type of array antenna offers a very good double reconfigurability capacity, but requires a large number of controls which often make its cost and its weight prohibitive. Furthermore, in transmission, the low efficiency of the amplifiers that are associated with each of the DRA controls induces an often prohibitive dissipation.

A second solution involves using an array of feeds in the focal plane or in the vicinity of the focal plane of a non-shaped parabolic reflector (or FAFR). This solution is described in particular in the document U.S. Pat. No. 4,965,587. In order to cover a given zone, the feed array is dimensioned in such a way that each of its feeds contributes to a part of the total coverage. The positioning of the feeds is directly linked to the zone to be covered. It is determined geometrically by applying the principle of reflection on the reflector. The amplitude/phase laws of the different controls must be optimized for the beams delivered by the feeds to combine and give a radiation pattern suited to each zone to be covered. If only one of the zones, provided initially, is to be covered, only a part of the corresponding array is used. The amplitude range applied to the radiating elements is large, which often makes it necessary, in transmission, to use a power balancing device between the amplifiers (called MPA).

The fact that each of the feeds is directly linked to a part of the coverage, on the one hand, imposes a redundancy on the amplifiers in order to avoid the loss of this zone in the event of a partial loss, and on the other hand, induces a number of feeds (and often of controls) that is directly linked to the size of the coverage. The beam-forming architecture is therefore particularly complex, induces additional losses linked to the presence of the MPA, and results in a fairly high volume and weight.

A third solution, a variant of the second, has been proposed in the US patent document 2004/0222932. It consists in placing a feed array in the focal plane of a reflector, the reflecting surface of which is shaped so as to spread the area covered by each beam having a "flat" radiation pattern in the main lobe delivered by an individual feed. The principle remains the same as that described above, each feed contributing only a part of the coverage. Because of the spreading of the individual beams introduced by the shaping of the reflector, the number of feeds needed to sample the coverage can then be reduced, which makes it possible to reduce the number of antenna controls.

SUMMARY OF THE INVENTION

Since no known solution provides full satisfaction in terms of cost and/or weight and/or simplicity of the controls and/or capacity for reconfigurability in orbit, the aim of the invention is therefore to improve the situation.

To this end, proposed is an array antenna with reflector(s) comprising i) an array of at least two feeds, including a so-called central feed, arranged and positioned so as to transmit (or receive) beams of electromagnetic waves in chosen directions, ii) beam-forming means for controlling the amplitude and phase of each of the feeds by means of amplitude/phase laws applied to their ports and for providing an appropriate amplification level, in order for each feed to transmit a chosen radiation pattern (forming a beam and comprising a main lobe) intended to cover a chosen zone, and iii) one or more reflectors for reflecting the beams delivered by the feeds (or toward these feeds).

This array antenna with reflector(s) is characterized by the fact that:

- the surface of at least one of its reflectors is shaped three-dimensionally (3D) so as to reflect the beam that is delivered by each feed and spread its energy so that it covers the chosen associated zone, that the main lobe of the radiation pattern associated with the central feed defines a so-called primary coverage fully including each active coverage zone of the antenna, of chosen form and dimensions, and that the main lobe of the radiation pattern associated with each non-central feed at least partially overlaps the primary coverage, and
- its beam-forming means are responsible for applying to the ports of the array of feeds an amplitude and/or phase law chosen such that the combination of the beams delivered by the feeds of the array defines each of the active coverage zones of the antenna.

The array antenna with reflector(s) according to the invention can include other characteristics which can be taken separately or in combination, and in particular:

- its feeds can be positioned either in the focal plane of the reflector, or outside the latter, in any manner in front of the reflector;
- its feeds can comprise a radiating element of any type (for example circular or rectangular horn, printed element (or "patch"), slot or helix) operating in transmit and/or receive mode and in any polarization;
- the surface of one of its reflectors preferably has a generally paraboloid form shaped three-dimensionally;

at least one of its reflectors can include a pointing mechanism for modifying the position of the main lobe associated with the central feed of the array.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWING

The present invention is illustrated by way of example, and not by limitation, in the figures of the accompanying drawings, wherein elements having the same reference numeral designations represent like elements throughout and wherein.

The appended drawings can be used not only to complement the invention, but also contribute to its definition, as appropriate.

Figure 1:
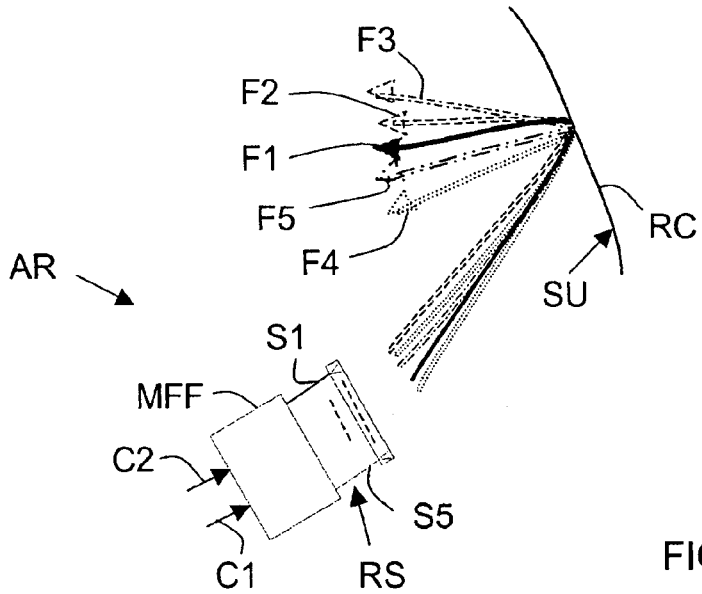
FIG. 1 very schematically and functionally illustrates an exemplary embodiment of an array antenna with reflector(s) according to the invention, and FIG. 2 diagrammatically illustrates the principle of forming active coverage zones by means of an array antenna with reflector(s) according to the inventor.

Reference is first of all made to FIG. 1 to describe an array antenna with reflector(s) AR according to the invention.

Hereinafter, it will be assumed by way of nonlimiting example that the array antenna with reflector(s) AR is dedicated solely to the transmission of beams of electromagnetic waves, that it comprises only a single reflector AR, that its array RS comprises only five feeds SI (i=1 to 5) and that it offers only two active coverage zones (ZC1 and ZC2). However, the invention is not limited to this application. In practice, the array antenna with reflector(s) according to the invention can operate in transmit or receive mode, or even in transmit and receive modes, and/or can include several reflectors, and/or can include an array consisting of any number of feeds, and/or can offer more than two active coverage zones. The main aim of such an antenna is to be mounted on board a telecommunication satellite.

An antenna (array antenna with reflector(s)) AR according to the invention firstly comprises an array RS consisting of at least two feeds Si arranged and positioned so as to deliver beams of electromagnetic waves Fi (comprising signals) in chosen directions. The number N of feeds Si of the array RS, the positioning of the feeds Si relative to each other, the type of the feeds Si and the respective orientations of the feeds Si are chosen according to the mission assigned to the antenna AR. It is assumed hereinafter, by way of nonlimiting example, that the number N of feeds Si is equal to 5 (i=1 to 5). However, this number N can be any value greater than or equal to 2.

Among these feeds Si, one (here S1) is called central, for example because it is placed roughly in the middle of the array RS.

Each feed Si of the array RS can comprise a radiating element of any type, and for example a circular or rectangular horn, a "patch" (printed element), a "slot", or a helix, that can operate in transmit and/or in receive mode and in any polarization.

The antenna AR also comprises a beam-forming module MFF for applying amplitude and/or phase laws and appropriately amplifying the signals from each of the N feeds Si of the array RS, in order for each feed Si to transmit a chosen radiation pattern (forming a beam Fi and comprising a main lobe) intended to cover a chosen zone Zi. Any known techniques for applying amplitude/phase and amplification laws can be implemented to this end.

The antenna AR also comprises a reflector RC provided with a surface SU shaped three-dimensionally (3D). This 3D shaping, which takes the form of hollows and bumps placed in chosen positions on the surface SU, is intended to reflect the beam Fi which is delivered by each feed Si and spread its energy so that, firstly, it covers the chosen associated zone Zi, secondly, that the main lobe of the radiation pattern associated with the central feed S1 defines a so-called primary coverage CP fully including each active coverage zone ZCj of the antenna AR, of chosen form and dimensions, and thirdly, that the main lobe of the radiation pattern associated with each non-central feed Si (i≠1), and therefore each zone Zi (i≠1), at least partially overlaps the primary coverage CP at an intersection zone ZICi.

The term "active coverage zone" should be understood here to mean a zone in which the electromagnetic waves transmitted by the antenna AR need to be able to be received by means of an appropriate receiver.

The zone Z1 (defined by the main lobe of the radiation pattern from the central feed S1 of the array RS) therefore defines a so-called primary coverage CP. Each point of this primary coverage CP is therefore located in at least one intersection zone ZICi, and preferably in several intersection zones ZICi. In other words, each point of the primary coverage CP is covered by the main lobe of the beam F1 from the central feed S1 and by one or more main lobes of the beams Fi (i≠1) associated with other feeds Si (i≠16) of the array RS.

The behavior of the antenna within the primary coverage CP has strong similarities with that of a direct radiation array (DRA).

Figure 2:
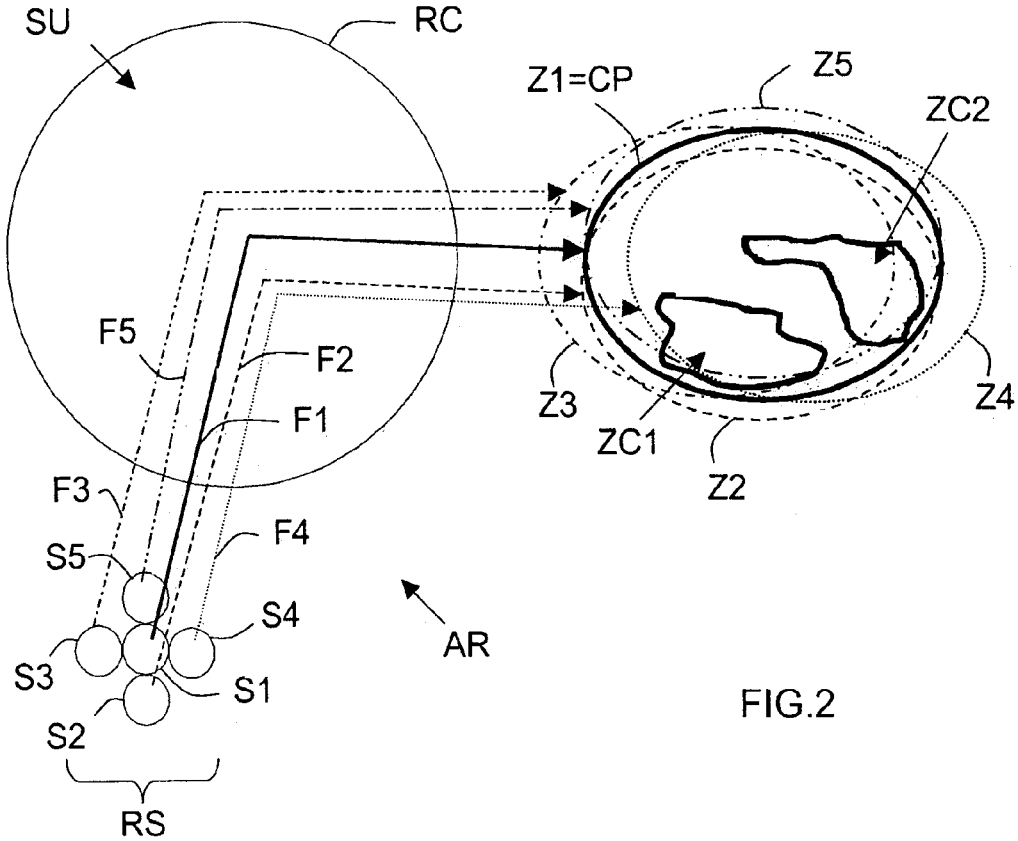

As indicated above, it is within the primary coverage CP that the active coverage zones ZCj of the antenna AR can be defined by means of the laws and amplifications applied by the beam-forming module MFF. In the non-limiting example illustrated in FIG. 2, the antenna AR is designed so as to offer two active coverage zones ZC1 and ZC2 (j=1 or 2). However, the antenna AR could be designed to offer more than two active coverage zones ZCj, or even just one.

The shaping of the reflector RC which makes it possible to spread the beams Fi is calculated according to the mission, since it is the latter that will define the envelope of the primary coverage CP that has to contain the various active coverage zones ZCj of the antenna AR. It is possible, for example, to determine the 3D shaping by means of polynomial functions (for example of Spline or Zernike type) applied to an initially paraboloid reflection surface, using appropriate software (for example of POS4 type). Depending on the mission, the feeds Si are placed either in the focal plane of the reflector RC, or outside this focal plane.

The reflector RC can include a pointing mechanism (not represented in the figures) intended to modify the position of the main lobe that is associated with the central feed S1 of the array AR.

The antenna AR according to the invention is particularly well suited, although not exclusively:

to a single-spot mode coverage with strong requirement for reconfigurability, for example in the case of a satellite that is reconfigurable according to its orbital position, and to wide coverage multi-spot missions, for example in the case of a CONUS type sampling by means of active coverage zones (or spots) of 0.4° diameter.

With the invention, the arrangement of the feed array is strongly decorrelated from the coverage of the antenna because it is the 3D shaping of the surface of the reflector which defines the primary coverage CP within which any number of spots (or active coverage zones ZCj) of any form can be defined. This makes it possible to considerably limit the size of the array and the number of feeds and consequently makes it possible to reduce in particular the weight and the complexity of the controls compared to a conventional solution with parabolic reflector or compared to a DRA-type solution.

Moreover, since a feed is no longer tied to creating a small part of an active coverage zone, as in the case of a conventional solution with parabolic reflector, a natural redundancy can be obtained via the feed array, such that the consequences of a partial failure are limited.

Furthermore, by reducing the size of the feed array, defocusing aberrations are reduced, lower side lobe levels (and therefore better C/I ratios) naturally result, compared to those obtained with a conventional solution with parabolic reflector. The use of low ratios between the focal distance of the reflector system and the diameter of the main reflector is then facilitated (with regard to implementation on a satellite).

The invention thus combines the advantages of a DRA (direct radiation array) antenna, namely a high reconfigurability and a natural redundancy, and the advantages of an FAFR antenna, namely a strong directivity obtained thanks to the shaped surface of the reflector, while avoiding the drawbacks of these two types of antennas, namely the very high number of controls which greatly contributes to the weight and the cost, the loss of effectiveness associated with the array lobes in the case of a DRA antenna, the loss of coverage in the event of failures and the size of the feed array according to the planned coverage in the case of an FAFR antenna.

The invention is not limited to the embodiments of array antenna with reflector(s) described above, purely by way of example, but it includes all the variants that can be envisaged by those skilled in the art within the framework of the claims below.

Thus, hereinabove, an exemplary array antenna with reflector(s) according to the invention has been described, dedicated to the transmission of electromagnetic waves. However, the invention is not limited to this example. It also in effect applies to array antennas with reflector(s) operating in receive mode or in transmit and receive modes.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. An array antenna with reflector(s), comprising:

i) an array of at least two feeds, including a central feed, arranged and positioned so as to transmit and/or receive beams of electromagnetic waves in chosen directions, ii) beam-forming means arranged to control the amplitude and phase of each of said feeds by means of amplitude/phase laws applied to their ports and to provide an appropriate amplification level, in order for each feed to transmit a chosen radiation pattern, forming a beam and comprising a main lobe, intended to cover a chosen zone, and iii) at least one reflector provided with a surface specifically for reflecting the beams delivered by said feeds and/or intended for said feeds, wherein said surface is shaped three-dimensionally, which takes the form of hollows and bumps placed in chosen locations on said surface so as to reflect the beam delivered by each feed and spread its energy so that it covers the chosen associated zone, that the main lobe of the radiation pattern associated with said central feed defines a so-called primary coverage fully including each active coverage zone of the antenna, of chosen form and dimensions, and that the main lobe of the radiation pattern associated with each non-central feed at least partially overlaps said primary coverage, and said beam-forming means are arranged to apply to the ports of the array of feeds an amplitude and/or phase law chosen such that the combination of the beams delivered by said feeds defines each of said active coverage zones.

2. The array antenna with reflector(s) as claimed in claim 1, wherein said primary coverage fully includes at least one active coverage zone.

3. The array antenna with reflector(s) as claimed in claim 2, wherein said primary coverage fully includes at least two active coverage zones.

4. The array antenna with reflector(s) as claimed in claim 2, wherein said feeds are positioned in a focal plane of one of said reflectors.

5. The array antenna with reflector(s) as claimed in claim 2, wherein said feeds are positioned outside a focal plane of one of said reflectors.

6. The array antenna with reflector(s) as claimed in claim 2, wherein said surface of said reflector has a generally paraboloid form shaped three-dimensionally.

7. The array antenna with reflector(s) as claimed in claim 2, wherein at least one of said reflectors comprises a pointing mechanism arranged to modify the position of the main lobe associated with said central feed of the array.

8. The array antenna with reflector(s) as claimed in claim 2, wherein each of said feeds comprises a radiating element chosen from a group comprising at least one circular or rectangular horn, a printed element, a slot, or a helix.

9. The array antenna with reflector(s) as claimed in claim 1, wherein said primary coverage fully includes at least two active coverage zones.

10. The array antenna with reflector(s) as claimed in claim 9, wherein said feeds are positioned in a focal plane of one of said reflectors.

11. The array antenna with reflector(s) as claimed in claim 9, wherein said feeds are positioned outside a focal plane of one of said reflectors.

12. The array antenna with reflector(s) as claimed in claim 9, wherein said surface of said reflector has a generally paraboloid form shaped three-dimensionally.

13. The array antenna with reflector(s) as claimed in claim 9, wherein at least one of said reflectors comprises a pointing mechanism arranged to modify the position of the main lobe associated with said central feed of the array.

14. The array antenna with reflector(s) as claimed in claim 9, wherein each of said feeds comprises a radiating element chosen from a group comprising at least one circular or rectangular horn, a printed element, a slot, or a helix.

15. The array antenna with reflector(s) as claimed in claim 1, wherein said feeds are positioned in a focal plane of one of said reflectors.

16. The array antenna with reflector(s) as claimed in claim 15, wherein said surface of said reflector has a generally paraboloid form shaped three-dimensionally.

17. The array antenna with reflector(s) as claimed in claim 1, wherein said feeds are positioned outside a focal plane of one of said reflectors.

18. The array antenna with reflector(s) as claimed claim 1, wherein said surface of said reflector has a generally paraboloid form shaped three-dimensionally.

19. The array antenna with reflector(s) as claimed in claim 1, wherein at least one of said reflectors comprises a pointing mechanism arranged to modify the position of the main lobe associated with said central feed of the array.

20. The array antenna with reflector(s) as claimed in claim 7, wherein each of said feeds comprises a radiating element chosen from a group comprising at least one circular or rectangular horn, a printed element, a slot, or a helix.

* * * * *